US005937939A

United States Patent [19]

Inaba et al.

[11] Patent Number: 5,937,939

[45] Date of Patent: Aug. 17, 1999

[54] JOINT PORTION OF HEAT EXCHANGER

[75] Inventors: Hiroyuki Inaba; Hideo Kobayashi, both of Tokyo, Japan

[73] Assignee: Calsonic Corporation, Tokyo, Japan

[21] Appl. No.: 09/207,510

[22] Filed: Dec. 9, 1998

Related U.S. Application Data

[62] Division of application No. 08/760,298, Dec. 4, 1996.

[30] Foreign Application Priority Data

Dec. 6, 1995 [JP] Japan ..... HEI 7-317864
Apr. 12, 1996 [JP] Japan ..... HEI 8-90840

[51] Int. Cl.[6] ..... F28F 9/04

[52] U.S. Cl. ..... 165/178; 165/173; 285/197

[58] Field of Search ..... 165/173, 178; 285/189, 192, 197

[56] References Cited

U.S. PATENT DOCUMENTS

| | | | |
|---|---|---|---|
| 5,228,727 | 7/1993 | Tokutake et al. | 285/189 |
| 5,379,834 | 1/1995 | Tokutake | 165/178 |
| 5,477,919 | 12/1995 | Karube | 165/176 |
| 5,526,876 | 6/1996 | Karube | 165/176 |
| 5,593,279 | 1/1997 | Hayashi | 415/213.1 |
| 5,711,370 | 1/1998 | Tanaka | 165/178 |

*Primary Examiner*—Allen Flanigan
*Attorney, Agent, or Firm*—Sughrue, Mion, Zinn, Macpeak & Seas, PLLC

[57] ABSTRACT

A second tubular portion, having a closed distal end, is formed at an inner surface of a connector block constituting the joint portion. A threaded hole, which is open to an outer surface of the connector block, is formed in the tubular portion. A bolt is threaded into the threaded hole to fix a piping joint to the connector block.

7 Claims, 11 Drawing Sheets

JOINT PORTION OF HEAT EXCHANGER

This is a divisional of application Ser. No. 08/760,298 filed Dec. 4, 1996, the disclosure of which is incorporated herein by reference.

BACKGROUND OF THE INVENTION

1. Field of the Invention

This invention relates to an improved joint portion of a heat exchanger which is mounted on the heat exchanger, such as a condenser used in an air conditioner of an automobile, and is fixedly secured to an outer surface of a peripheral wall of a header which passes therethrough a fluid (e.g. a cooling medium) to be subjected to heat exchange.

2. Description of the Related Art

One known heat exchanger, used in an automobile air conditioner, is shown in FIG. 9. This heat exchanger 1 is constituted by combining various parts of an aluminum alloy together. More specifically, this heat exchanger 1, made of aluminum, comprises a plurality of parallel, spaced tubes 2 of a generally flattened cross-section, corrugated fins 3 each held between the corresponding two adjacent tubes 2 and 2, and a pair of headers 4 and 5 to which opposite ends of each of the tubes 2 are brazed liquid-tight, respectively, so that the two headers 4 and 5 are in communication with each other. A joint portion 6 is secured by brazing to an upper end portion of the header 4, and a joint portion 7 is secured by brazing to a lower end portion of the header 5, and for example, a piping joint 21 (see FIG. 12), which passes therethrough a fluid to be subjected to heat exchange, is adapted to be connected to the joint portion 6, 7. In FIG. 9, reference numeral 8 denotes a bracket by which the heat exchanger 1 is fixedly secured to a vehicle body. The brazing of a core portion 9 (comprising the tubes 2, the fins 3 and so on), and the brazing of the joint portions 6 and 7, are effected simultaneously by a known heat treatment in a furnace.

In the heat exchanger 1 of the above construction, the joint portion 6 serves as an inlet portion for the fluid (e.g. cooling medium) to be subjected to heat exchange whereas the joint portion 7 serves as an outlet portion for this fluid. With respect to the construction of the joint portions 6 and 7, for example, the joint portion 7 will be described briefly. A first through hole 11 is formed through a peripheral wall 10 of the header 5 at the lower end portion thereof. The joint portion 7 comprises a connector block 13 of a generally rectangular parallelepiped shape. An inner surface (left surface in FIGS. 10 and 11) of the connector block 13 is defined by a concavely-curved, arcuate surface 12 substantially equal in radius of curvature to the outer peripheral surface of the peripheral wall 10 of the header 5. The connector block 13 is fixedly secured to the header 5, with the concavely-curved surface 12 mated with the outer peripheral surface of the header 5, in such a manner that the first through hole 11 is covered with the connector block 13. A flow hole 14 is formed through a lower end portion of the connector block 13, and extends between the inner surface and the outer surface (right surface in FIGS. 10 and 11) thereof. The flow hole 14 has a smaller-diameter portion 16 open to the inner surface of the connector block 13, and a tapered hole portion 17 open to the outer surface of the connector block 13. A pipe piece 19 is fixedly fitted in the smaller-diameter portion 16 to form a first tubular portion 20 projecting from the concavely-curved surface 12. The first tubular portion 20 has such an outer diameter that it can be snugly fitted in the first through hole 11. A threaded hole 15 is formed through an upper end portion of the connector block 13, disposed above the flow hole 14, and extends between the inner and outer surfaces of the connector block 13 in parallel relation to the flow hole 14.

The connector block 13 is connected to the head 5, with the first tubular portion 20 fixedly fitted in the first through hole 11, and with the concavely-curved surface 12 mated with part of the outer peripheral surface of the header 5, and in this condition the connector block 13 is brazed to the header 5. As a result, the connector block 13 is fixedly secured liquid-tight to the header 5 in a manner shown in FIG. 10, thus forming the joint portion 7.

The piping joint 21 is connected to the joint portion 7 to form a flow passage for the fluid (e.g. cooling medium) to be subjected to heat exchange. For example, the piping joint 21 has a generally rectangular parallelepiped shape as shown in FIG. 12, and has an inner surface (left surface in FIG. 12) to be mated with the outer surface of the connector block 13. The piping joint 21 has at its lower end portion a cylindrical connection portion 22 which is adapted to be fitted in the flow hole 14. An O-ring 23 is mounted on an outer peripheral surface of the connection portion 22 intermediate opposite ends thereof. The connection portion 22 communicates with a pipe 24. A bolt insertion hole 25 is formed through an upper end portion of the piping joint 21 disposed above the pipe 24.

The piping joint 21 of this construction is connected to the joint portion 7, with the connection portion 22 fitted in the flow hole 14 in the joint portion 7 (FIGS. 10 and 11) and with the inner surface of the piping joint 21 mated with the outer surface of the connector block 13. In this condition, the O-ring 23 is held in intimate contact with the inner peripheral surface of the smaller-diameter portion 16, thus forming a seal therebetween. Then, a bolt 26 is inserted into the bolt insertion hole 25, and is threaded into the threaded hole 15 in the joint portion 7, and is tightened, thereby fixedly securing the piping joint 21 to the joint portion 7.

The joint portion 7 (The joint portion 6 has a similar construction, but is inverted in an upward-downward direction relative to the joint portion 7) and the piping joint 21 (A piping joint to be connected to the joint portion 6 has a similar construction) are constructed as described above, and are mounted on the heat exchanger 1. When the heat exchanger 1 is used as a condenser, the fluid (e.g. cooling medium) to be subjected to heat exchanger is fed into the header 4 via piping (not shown) connected to the joint portion 6. The thus fed fluid flows through the headers 4 and 5 and the tubes 2 in a sequentially manner, and further flows into the pipe 24 via the joint portion 7 and the piping joint 21.

However, in the joint portion of the conventional heat exchanger of the above construction, the thickness of the connector block 13 must be increased to a certain degree because of the formation of the threaded hole 15. Therefore, when the joint portion 7 is connected to the header 5, the amount $t_1$ (FIG. 10) of projecting of the joint portion 7 from the header 5 is large, and the mounting operation can not be effected efficiently within a narrow engine room.

There has been another problem in the conventional joint portion. FIGS. 13 and 14 show another example of the conventional joint portion 7. The joint portion 7 comprises a connector body 47 fixedly secured to the outer surface of the upper end portion of the header 5, and a connection tube 48 provided on the connector body 47, and an end of a pipe (not shown), through which a cooling medium flows, is connected to the connection tube 48.

The connector body 47 has a flow hole 14, and an outer half (right half in FIGS. 13 and 14) of a pipe piece 19 is fitted in an inner half (left half in FIGS. 13 and 14) of the flow hole 14. That portion (larger-diameter portion 49) of the flow hole 14 close to the concavely-curved surface 12 is larger in diameter than that portion thereof close to the outer surface. The outer half of the pipe piece 19 is fitted in the larger-diameter portion 49. The inner half of the pipe piece 19 is fitted in a through hole 11 formed in the header 5, and communicates with the bore of the header 5. In FIGS. 13 and 14, reference numeral 15 denotes a threaded hole used for threadedly fixing a mounting block of a liquid tank or other device. A peripheral groove 50 is formed in an outer peripheral surface of the connection tube 48 formed integrally with the connector body 47, and an O-ring is mounted in this peripheral groove 50 so as to form a seal between the connection tube 48 and the pipe connected to this connection tube 48.

The joint portion 7 of the above construction for the heat exchanger is formed by skiving or cutting a single block of an aluminum alloy in such a manner that the connecting tube 48 is integral with the connector body 47. More specifically, as shown in FIG. 15, the block 51, having the concavely-curved surface 12 substantially conforming to the outer surface of the headers 4 and 5 (FIGS. 9 and 13), is cut from the outer side, thereby removing those portions indicated by dots-and-dash lines, thus forming a projected portion 52 serving as the connection tube 48. Then, the flow hole 14 is formed through the block 51 axially of the projected portion 52. As described above, that portion of the flow hole 14 close to the concavely-curved surface 12 defines the larger-diameter portion 49 into which the pipe piece 19 is fitted. Thus, the cutting operation and the formation of the flow hole 14 are troublesome, and the efficiency of processing the material, as well as the yield of the material, is poor, which leads to a high cost.

SUMMARY OF THE INVENTION

A joint portion of a heat exchanger according to the present invention has been made in view of these problems.

According to a first aspect of the present invention, there is provided a joint portion fixed on a header of a heat exchanger and jointing the heat exchanger with a foreign member, comprising: a flow hole through which a fluid passes and being communicated with a first through hole formed in a peripheral wall of the header; and a threaded hole open to an outer surface of the joint portion, a bolt is threaded into the threaded hole to fix the foreign member to the joint portion; wherein a second through hole is formed through the peripheral wall of the header in spaced relation to the first through hole, and a part of the threaded hole is formed in an inside of the header through the second through hole.

According to a second aspect of the invention, there is provided a joint portion fixed on a header of a heat exchanger and jointing the heat exchanger with a foreign member, comprising: a connector body fixed to an outer surface of the header, a through hole being formed extending through the connector body; and a pipe piece fixed in the through hole; wherein an intermediate portion of the pipe piece is snugly fitted in the through hole with its inner and outer end portions projecting respectively from inner and outer surfaces of the connector body, and the inner end portion of the pipe piece projecting from the inner surface is fitted in a through hole formed in the header.

The joint portion of the heat exchanger according to the present invention has the above construction, and the amount of projecting of the joint portion from the header is small. And besides, the joint portion can be easily and positively positioned and retained in position before brazing when the joint portion is to be connected to the header.

Further, in the joint portion of the heal exchanger according to the invention, the connection tube is formed not by cutting the connector body but by the member separate from the connector body. And besides, the flow hole for passing this connection tube through the connector body can be easily formed. Therefore, the efficiency of processing the material, as well as the yield of the material, is enhanced, so that the cost can be reduced.

DETAILED DESCRIPTION OF THE PREFERRED EMBODIMENTS

Figure 1:
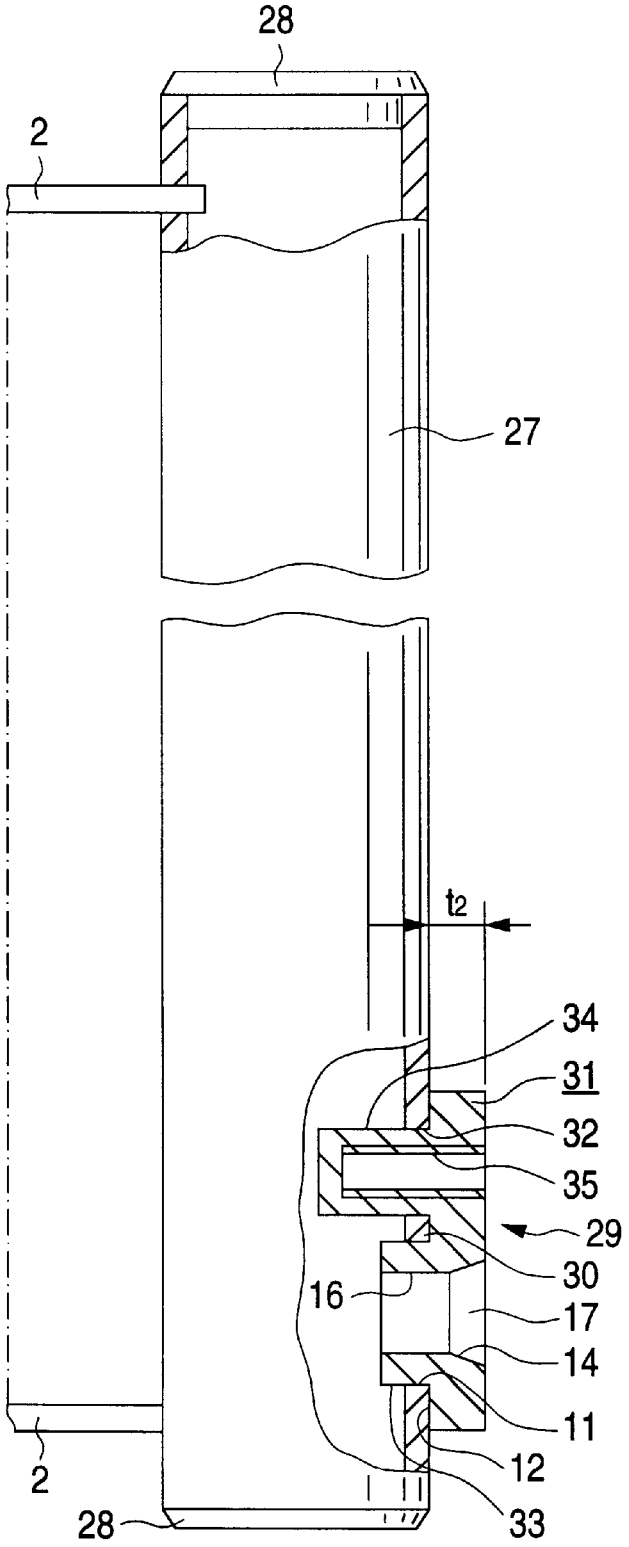
FIG. 1 is a partly cross-sectional view of a first embodiment of the present invention.
Figure 2:
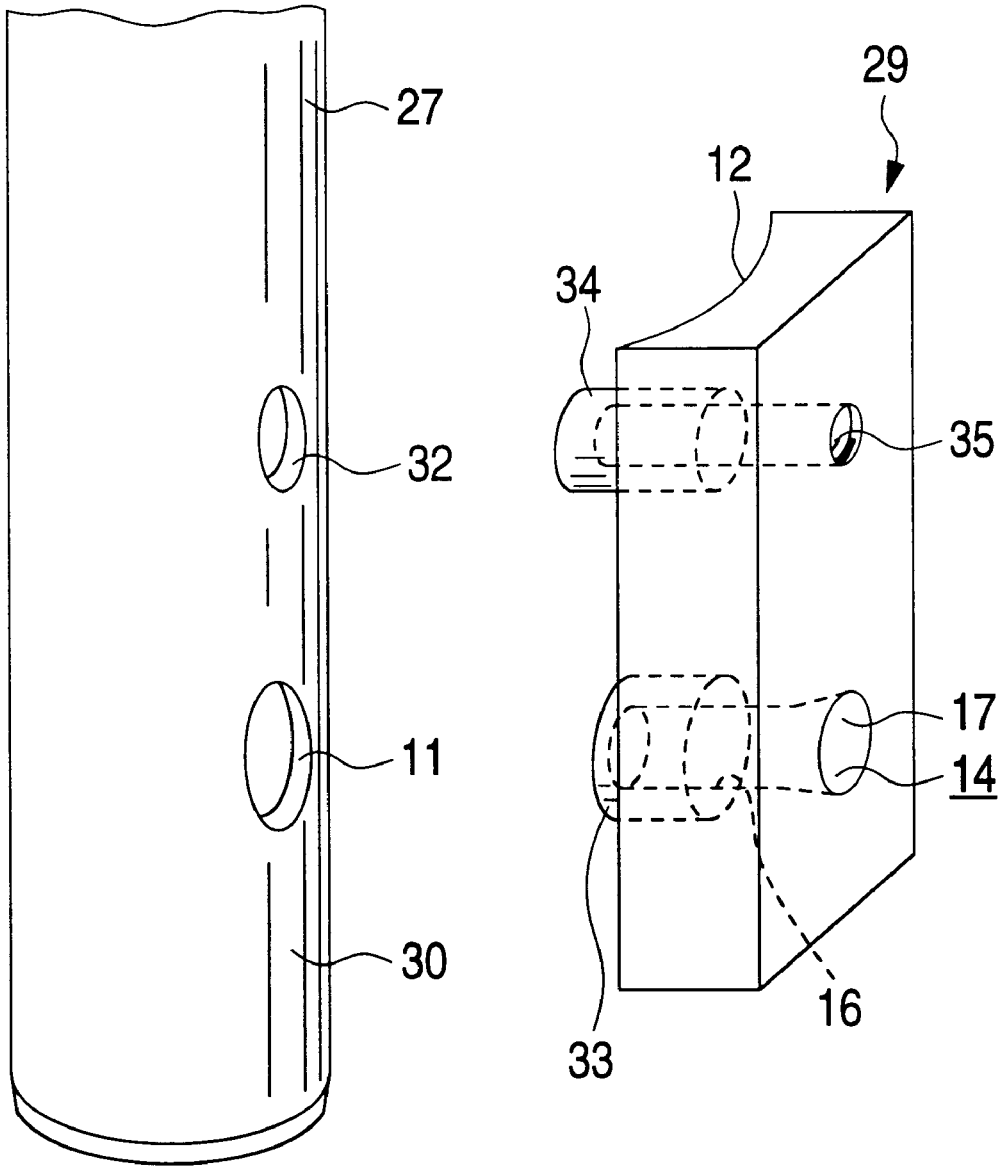
FIG. 2 is a perspective view of a lower portion of FIG. 1, showing a header and a joint portion in a disassembled condition.
Figure 5:
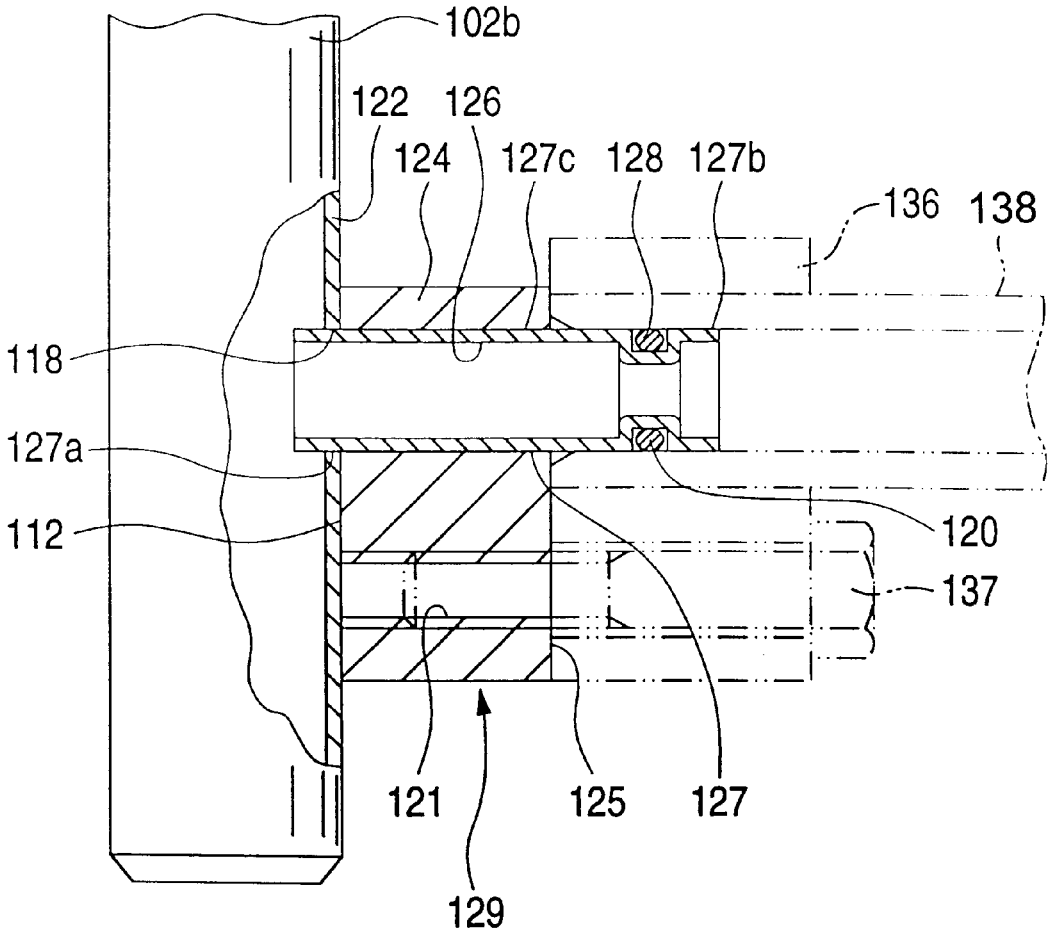
FIG. 5 is a partly cross-sectional view of a fourth embodiment of the present invention.

FIGS. 1 and 2 show a first embodiment of the present invention. In the first embodiment shown in FIGS. 1 and 2, the showing and description of part of those portions corresponding to those of the above conventional construction will be omitted. Therefore, in FIGS. 1 and 2, the showing of a heat exchanger body as in FIG. 5 is omitted, and the relation between a header 27 and a joint portion 29, fixedly secured thereto, is shown.

The header 27, corresponding to the header 5 of the above conventional construction, is made of an aluminum alloy, and has a circular or a generally circular cross-section. Upper and lower open ends of the header 27 are closed air-tight and liquid-tight by plugs 28 and 28, respectively.

The joint portion 29 is fixedly secured to an outer surface of a lower end portion of the header 27. A first through hole 11 and a second through hole 32 are formed through a peripheral wall 30 of the header 27 at the lower end portion thereof.

The joint portion 29 comprises a connector block 31 of a generally rectangular parallelepiped shape formed, for example, by die casting, forging or skiving an aluminum alloy. An inner surface (left surface in FIGS. 1 and 2) of the connector block 31 is defined by a concavely-curved, arcuate surface 12 substantially equal in radius of curvature to the outer peripheral surface of the header 27. The connector block 31 is fixedly secured to the head 27 in such a manner that the first and second through holes 11 and 32 are covered with the connector block 31. A flow hole 14 is formed through a lower end portion of the connector block 31, and extends between the inner surface and the outer surface (right surface in FIGS. 1 and 2) thereof. A first tubular portion 33 projects from the inner surface of the connector block 31 in surrounding relation to one end of the flow hole 14, and is adapted to be snugly fitted in the first through hole 11. A second tubular portion 34 projects from that portion of the concavely-curved surface 12 spaced from the first tubular portion 33.

An outer portion of the flow hole 14 close to the outer surface of the connector block 31 is defined by a tapered hole portion 17 increasing in diameter progressively toward its outer open end. The second tubular portion 34 is parallel to the flow hole 14, and a threaded hole 35 with a closed end is formed in the second tubular portion 34, and extends in parallel relation to the flow hole 14.

Figure 12:
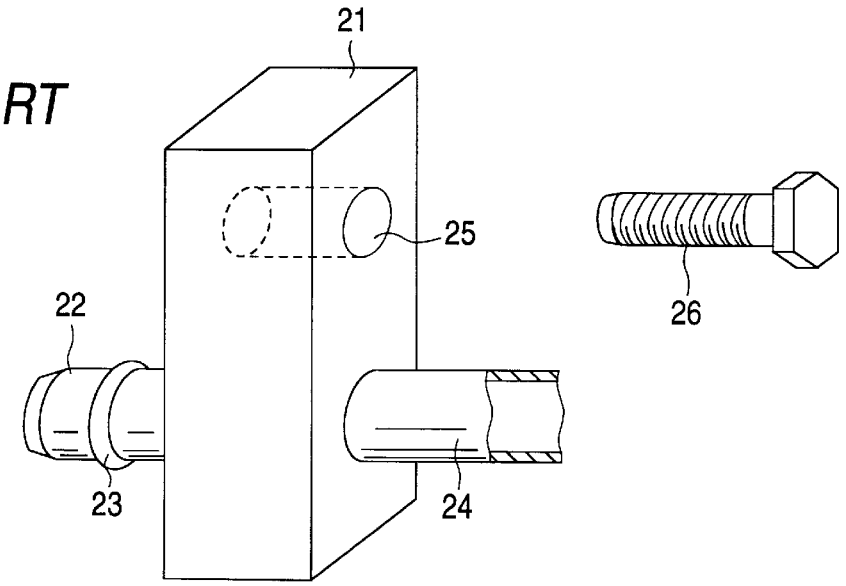
FIG. 12 RELATED ART
FIG. 12 is a partly-broken, perspective view showing one example of piping joint.

The joint portion 29 of the above construction is connected to the head 27, with the first and second tubular portions 33 and 34 fitted respectively in the first and second through holes 11 and 32, and with the concavely-curved surface 12 mated with the head 27. In this connected condition, the joint portion 29 is brazed to the header 27, and therefore the joint portion 29 is fixedly secured liquid-tight to the header 27 in a manner shown in FIG. 1. A piping joint 21 as shown in FIG. 12 is connected to the joint portion 29.

Figure 9:
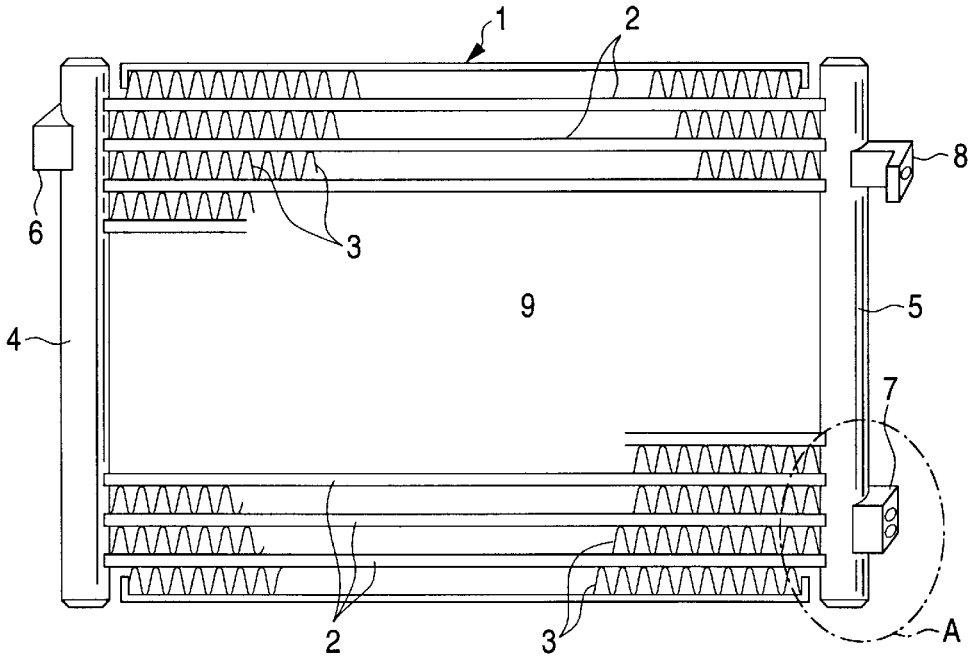
FIG. 9 RELATED ART
FIG. 9 is a generally front-elevational view of a conventional heat exchanger, with some parts seen obliquely from the upper side.
Figure 10:
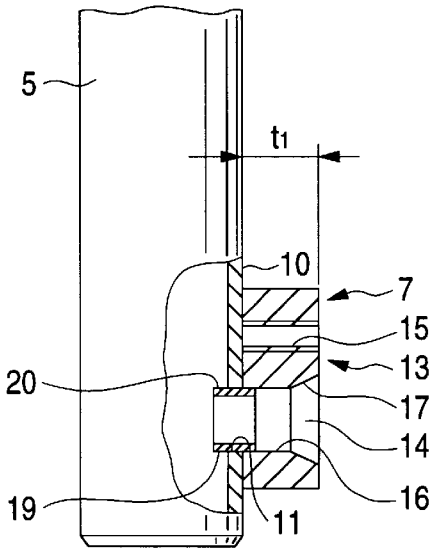
FIG. 10 RELATED ART
FIG. 10 is a partly-broken, enlarged view of a portion A of FIG. 9.
Figure 11:
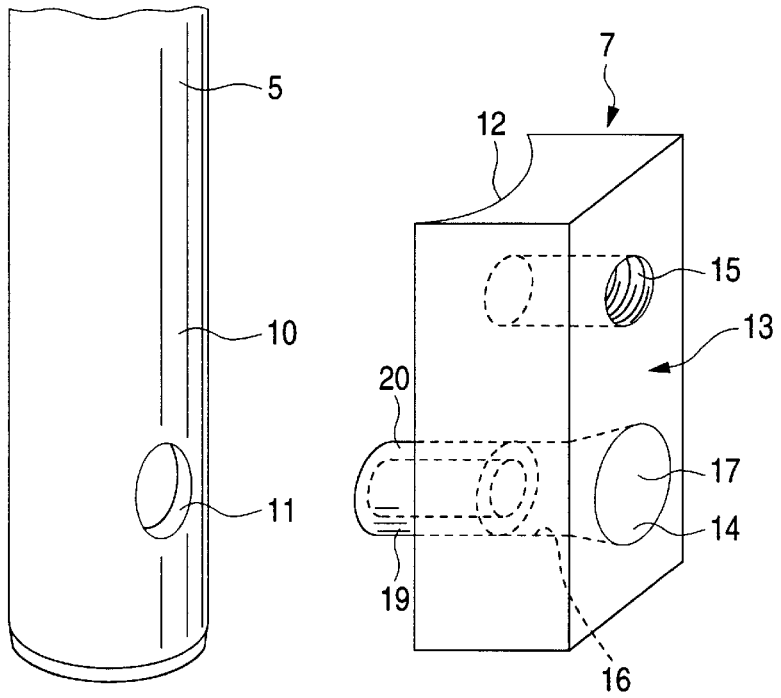
FIG. 11 RELATED ART
FIG. 11 is an enlarged perspective view showing a header and a joint portion in a disassembled condition.

In the above joint portion of the invention for the heat exchanger, the distal end portion (left end portion in FIGS. 1 and 2) of the second tubular portion 34 (which has the threaded hole 35 therein) is received in the header 27, and a distal end portion of a bolt (not shown), connecting the piping joint 21 and the connector block 31 together, is threaded into the distal end portion of the threaded hole 35 formed in the distal end portion of the second tubular portion 34. Therefore, even if the length of the threaded hole 35 is increased in order to increase the connecting strength achieved by the bolt, the amount $t_2$ of projecting of the joint portion 29 from the outer surface of the header 27 is sufficiently smaller than the amount $t_1$ in the above conventional construction ($t_2<t_1$). Therefore, the heat exchanger, having the joint portions, can be easily mounted in a narrow engine room. And besides, the width of the heat exchanger can be increased, so that the performance of the heat exchanger is enhanced. In the illustrated embodiment, although the joint portion, serving as an outlet portion for a cooling medium, has been described, a joint portion (corresponding to the joint portion 6 shown in FIG. 9), serving as an inlet portion for the cooling medium, is similar in construction to this embodiment, and the amount of projecting of this inlet-side joint portion can be made smaller. However, in this case, the inlet-side joint portion is inverted in an upward-downward direction relative to the joint portion of this embodiment.

Figure 3:
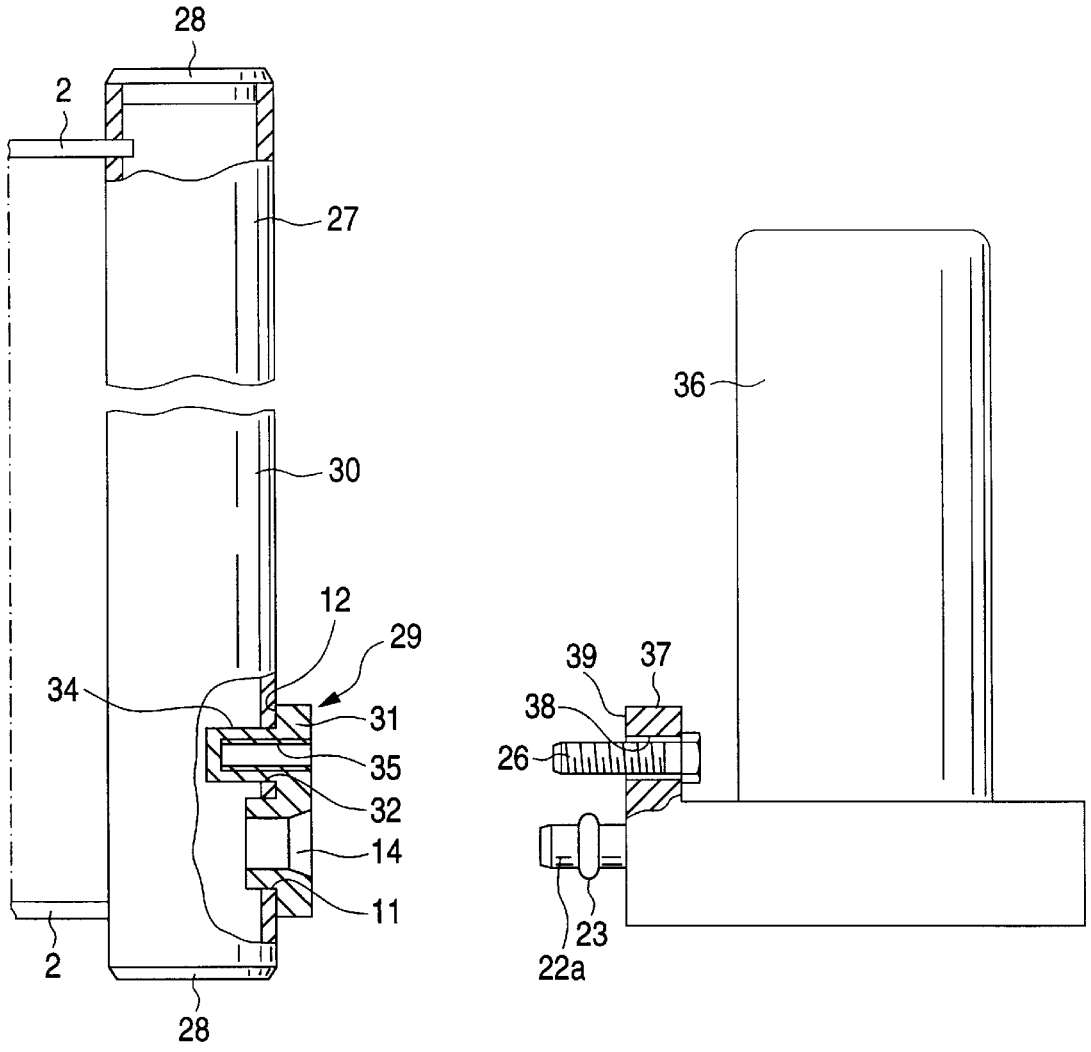
FIG. 3 is a perspective view of a second embodiment of the invention in which a liquid tank is connected directly to a joint portion.

FIG. 3 shows a second embodiment of the invention in which a liquid tank 36 is connected directly to a joint portion without the use of a piping joint. In this embodiment, a connecting portion 37, corresponding to the piping joint 21 shown in FIG. 12, is formed at a lower end of the liquid tank 36. The connecting portion 37 includes a connection portion 22*a* having an O-ring 23 mounted thereon, and a flange portion 39, and a bolt insertion hole 38 is formed through the flange portion 39. The connection portion 22*a* is inserted into a flow hole 14 in a joint portion 29 as described above in the first embodiment, with a seal formed therebetween by the O-ring 23, and a bolt 26 is threaded into a threaded hole 35, and is tightened, thereby connecting the liquid tank 36 of the above construction to the joint portion 29 fixedly secured to the header 27.

Figure 4:
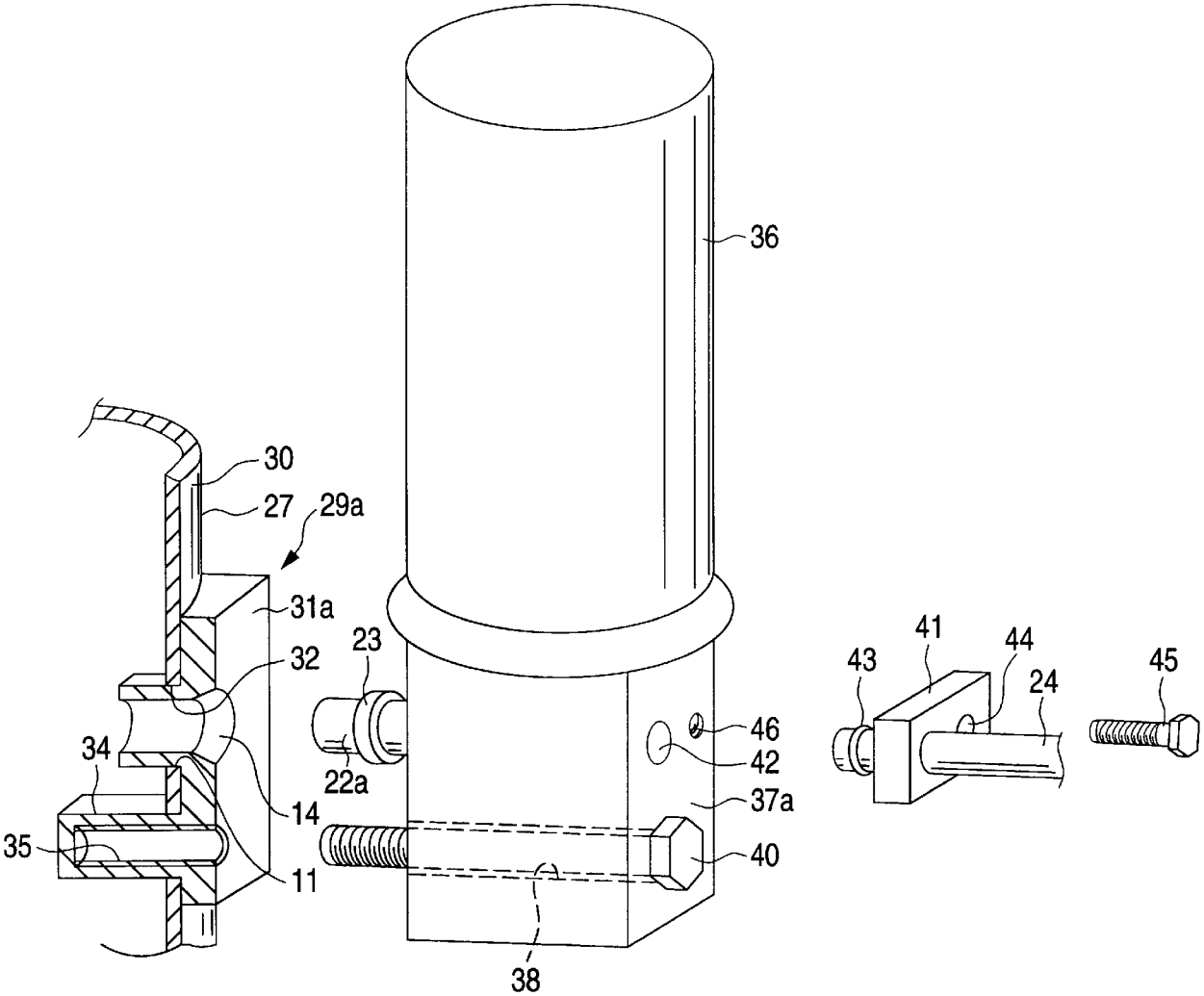
FIG. 4 is a partly-broken, perspective view of a third embodiment of the invention.

FIG. 4 shows a third embodiment of the invention in which a liquid tank 36 is connected directly to a joint portion as in the second embodiment. In this embodiment, the positional relation between a connection portion 22*a* and a bolt insertion hole 38 is inverted in an upward-downward direction with respect to the second embodiment. More specifically, the bolt insertion hole 38 is formed through a lower end portion of a connecting portion 37*a* formed at a lower end of the liquid tank 36, and a bolt 40 is passed through the bolt insertion hole 38 to fix the connecting portion 37*a* to a header 27. The connection portion 22*a* projects from an upper portion of an inner surface of the connecting portion 37*a* facing the header 27. A through hole 42 is open at one end thereof to an outer surface of the connecting portion 37*a* facing away from the header 27, and is open at the other end thereof to a distal end of the connection portion 22*a*. A threaded hole 46 is formed in an upper portion of the outer surface of the connecting portion 37*a* in juxtaposed relation to the through hole 42. A bolt 45 is threaded into the threaded hole 46 to fix a bracket 41, mounted on an end portion of a pipe 24, to the connecting portion 37*a*. A through hole 44 is formed through the bracket 41, and when the end portion of the pipe 24 is inserted into the through hole 42, the through hole 44 is aligned with the threaded hole 46. Therefore, the end portion of the pipe 24 is thus inserted into the through hole 42, and in this condition the bolt 45 is passed through the through hole 44, and is threaded into the threaded hole 46, and is tightened, thereby connecting the pipe 24 to the connecting portion 37*a*. Reference numeral 43 denotes an O-ring mounted on the end portion of the pipe 24.

As in the first and second embodiments, a connector block 31*a* is mounted at a lower end portion of a peripheral wall 30 of the header 27. However, in this embodiment, the positional relation between the connection portion 22*a* and the bolt insertion hole 38 is inverted in the upward-downward direction with respect to the first and second embodiments, and in this connection a flow hole 14 is formed in an upper portion of the connector block 31*a* while a threaded hole 35 is formed in a lower portion thereof. In this embodiment of the above construction, in addition to the advantageous effect of the second embodiment, there is achieved an advantage that the connecting portion 37*a* can be more easily connected to the connector block 31*a*. Namely, in this embodiment, the operation, in which the bolt 40 is inserted into the bolt insertion hole 38, and is threaded into the threaded hole 35, can be effected at the outer side (the right side in FIG. 4) of the connecting portion 37*a*. Any member, which interferes with the insertion of the bolt 40 into the bolt insertion hole 38 and the threading of the bolt 40 into the threaded hole 35, exists at this outer side, and therefore the connection of the connecting portion 37*a* to the connector block 31*a* can be effected more easily.

Figure 6:
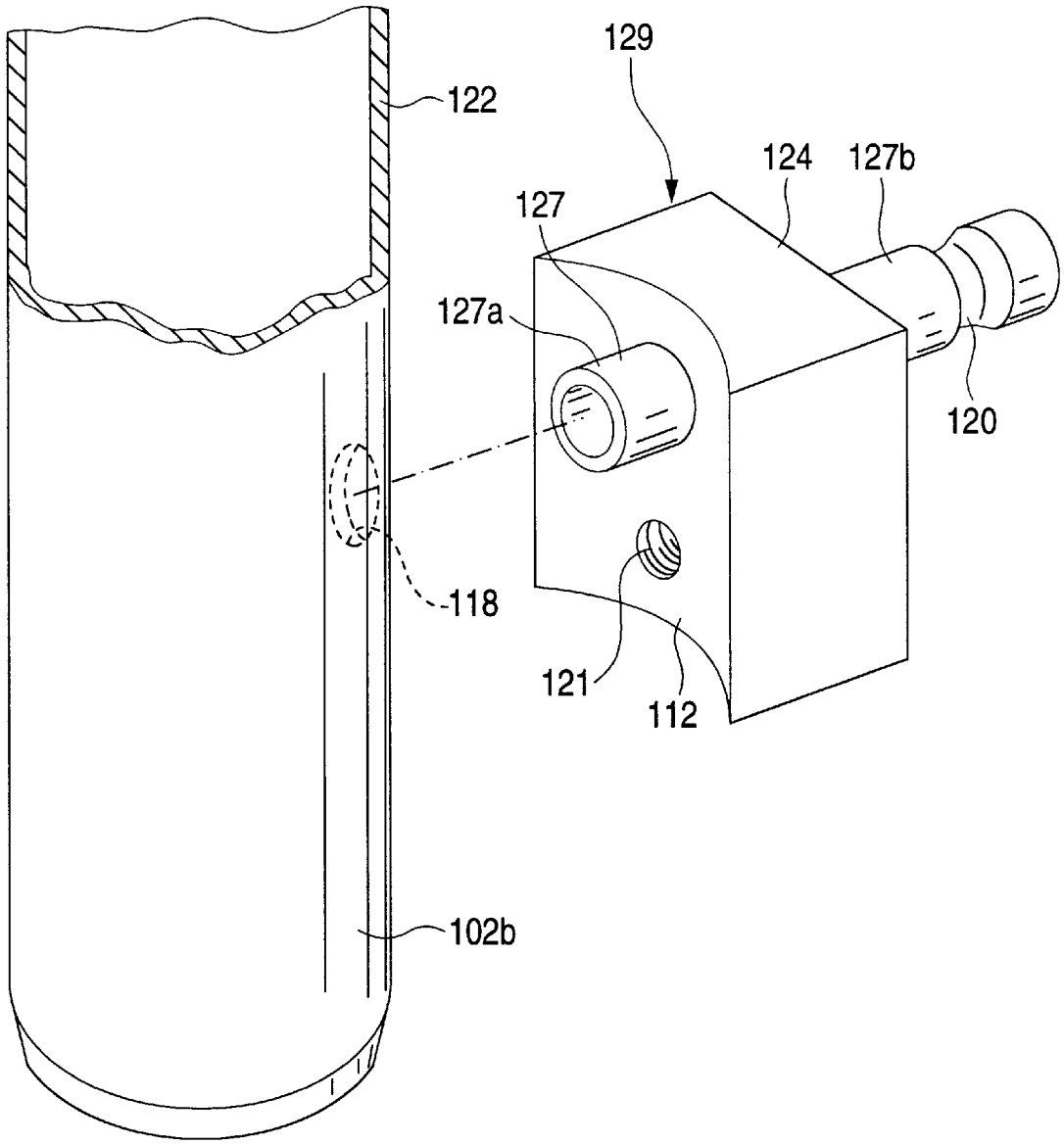
FIG. 6 is an exploded, perspective view of the above important portion.

FIGS. 5 and 6 show a joint portion 129 mounted on a lower end portion of a header 102*b* according to a fourth embodiment of the invention. A through hole 118 is formed through a peripheral wall 122 of the header 102*b* at the lower end portion thereof, and the joint portion 129 is fixedly secured to the header 102*b* in such a manner that the through hole 118 is covered by the joint portion 129. A connector body 124 of a generally rectangular parallelepiped shape, made of an aluminum alloy, includes an concavely-curved portion 112 of an arcuate shape substantially conforming to the outer surface of the header 102*b*, a through hole 126 of a circular shape which extends through the connector body 124 from its outer surface 125 to its concavely-curved portion 112, and is not varied in cross-sectional area and cross-sectional shape over the entire length thereof, and a threaded hole 121 into which a bolt 137 is threaded so as to connect a pipe-connecting flange 136.

A pipe piece 127 extends through the connector body 124, and passes through the outer and inner surfaces 125 and 112, and is brazed to the connector body 124. The pipe piece 127 is formed by cutting a long pipe material of an aluminum alloy into a predetermined length, which pipe material has such an outer diameter that the outer peripheral surface of the pipe piece 127 is in intimate contact with the inner surface of the through hole 126. The pipe piece 127 is brazed to the connector body 124, and in this condition an inner end portion 127*a* of the pipe piece 127 projects from the concavely-curved portion 112 while an outer end portion 127*b* thereof projects from the outer surface 125. The inner end portion 127*a* projects through the through hole 118 into the header 102*b*. The outer end portion 127*b* is sufficiently long that a pipe 138 can be positively fitted on the outer end portion 127*b*. A peripheral groove 120 is formed in the outer peripheral surface of the outer end portion 127*b*, and an O-ring 128 is retained in this peripheral groove 120.

In the joint portion 129 constituted by the connector body 124 and the pipe piece 127, an intermediate portion 127*c* of the pipe piece 127 is snugly fitted in the through hole 126 in the connector body 124. When the joint portion 129 is connected to the header 102*b*, the inner end portion 127*a* of the pipe piece 127 is fitted in the through hole 118 in the header 102*b*, with the inner surface of the connector body 124 mated with the outer surface of the header 102*b*. In this assembled condition, the mated surfaces are brazed together, thereby providing the joint portion 129 in a manner shown in FIG. 5.

Figure 13:
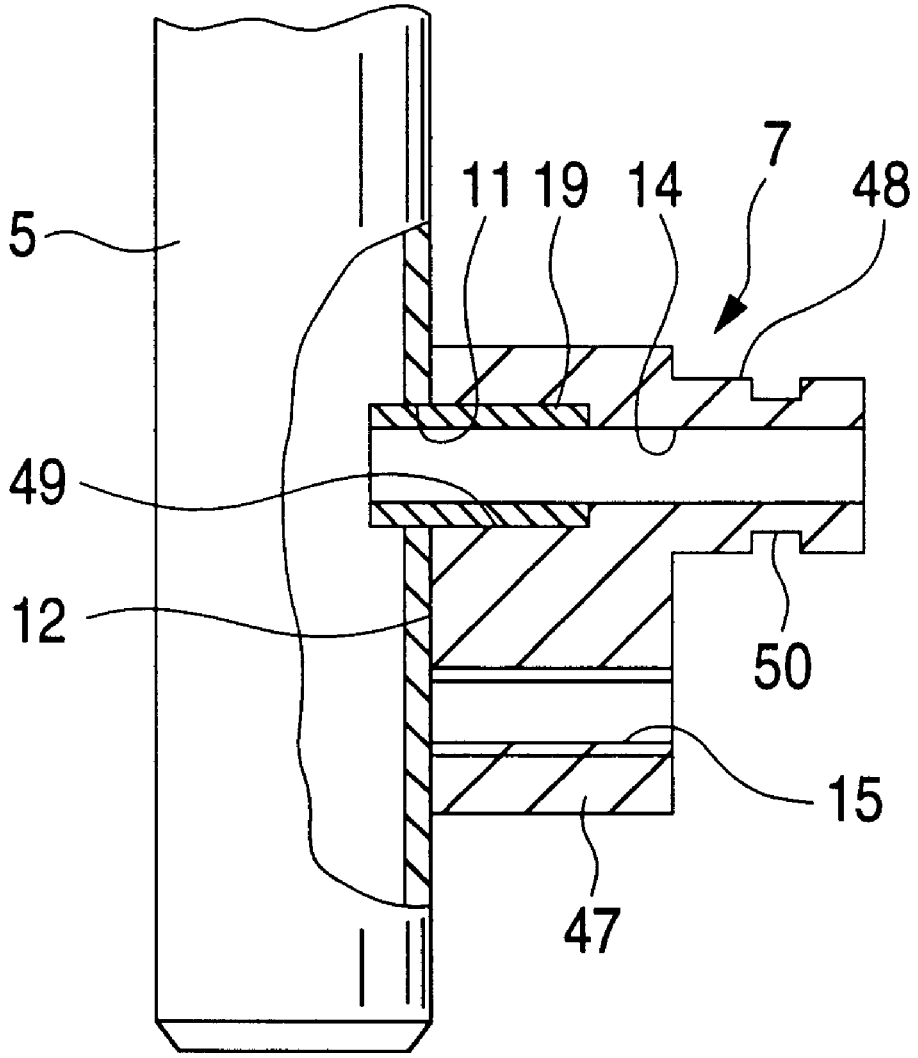
FIG. 13 RELATED ART
FIG. 13 is a partly cross-sectional view showing another example of the joint portion.
Figure 14:
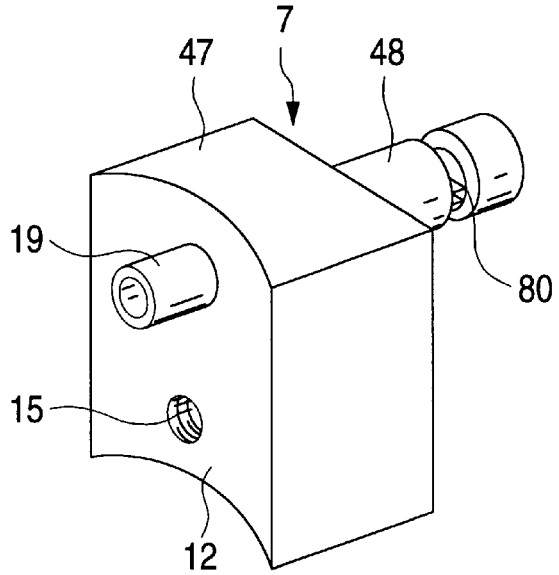
FIG. 14 RELATED ART
FIG. 14 is a perspective view of the another example of the joint portion.
Figure 15:
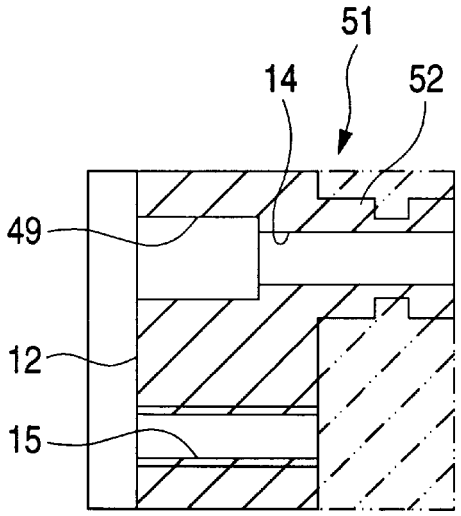
FIG. 15 RELATED ART
FIG. 15 is a front view showing a method of producing the conventional joint portion.

The joint portion of the heat exchanger according to the present invention is of the above construction, and therefore the cutting operation for forming the projected portion 52 (FIG. 15) on the connector block 51 shown in FIGS. 13 and 14 is not required. And besides, since the through hole 126, formed in the connector body 124, is not varied in cross-sectional area and cross-sectional shape over the entire length thereof, the through hole 126 can be formed easily. Therefore, the processing efficiency and the yield of the material are enhanced, so that the cost can be reduced.

Figure 7:
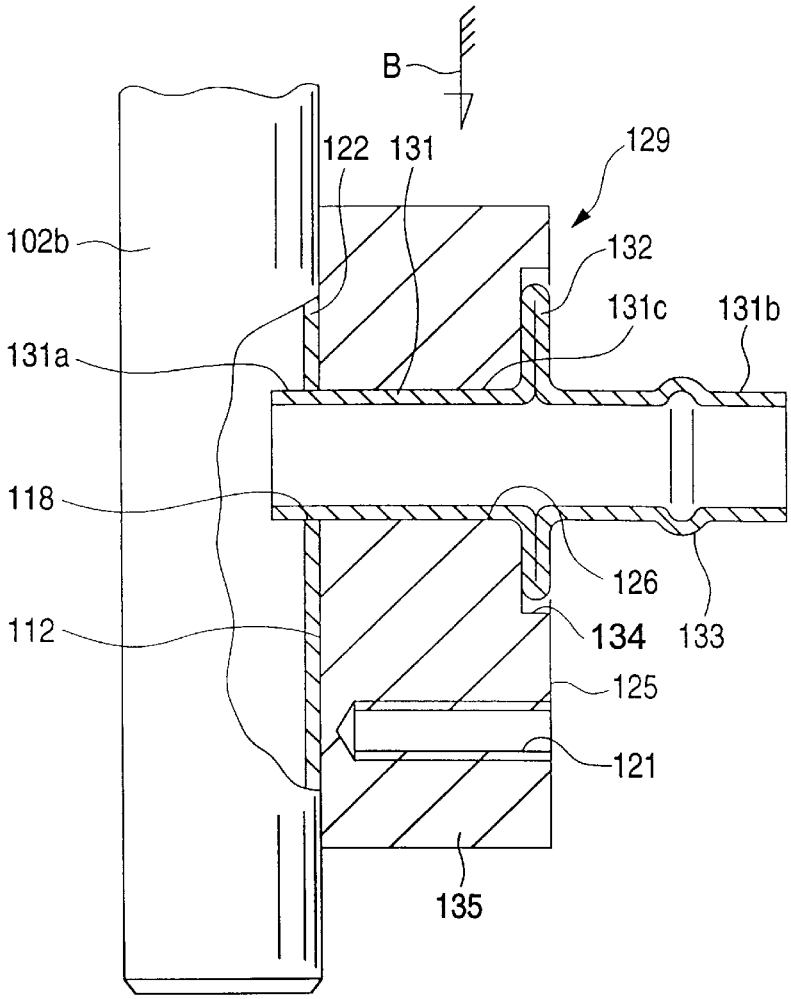
FIG. 7 is a cross-sectional view showing a fifth embodiment of the invention.
Figure 8:
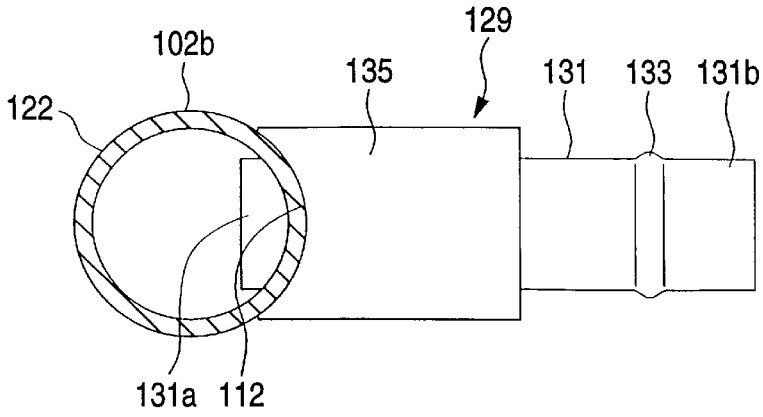
FIG. 8 is a view as seen in a direction of arrow B of FIG. 7.

FIGS. 7 and 8 show a fifth embodiment of the invention. A pipe piece (or pipe) 131, constituting a joint portion 129, has a radially-extending flange 132 formed on an intermediate portion 131*c* thereof. This flange 132 serves as a stopper. A peripheral projection 133 is formed on an outer end portion 131*b*. Therefore, when the pipe piece 131 is inserted into a through hole 126 in a connector body 135, the positioning of the pipe piece 131 in the axial direction (right-left direction in FIG. 7) can be easily effected by the flange 132. More specifically, the flange 132 is abutted against a recessed portion 134 (described later), with an inner end portion 131*a* of the pipe piece 131 projecting a predetermined length from an concavely-curved portion 112 of the connector body 135. An O-ring, which forms a air-tight, liquid-tight seal between the outer end portion 131*b* and a pipe (not shown) connected thereto, is positioned by the peripheral projection 133. In this embodiment, the recessed portion 134 is formed in an outer surface 125 of the connector body 135, and the flange 132 is received in the recessed portion 134. The other construction and operation are the same as described for the first embodiment.

In the above fourth and fifth embodiments, although the joint portions 129, mounted on the lower end portion of the header 102*b*, have been described, a joint portion, mounted on the upper end portion of the header, can have a similar construction. Namely, the present invention is not limited to the illustrated embodiments, and can be applied to heat exchangers of other constructions.

The joint portion of the heat exchanger according to the invention are constructed as described above, and therefore the amount of projection of the joint portion from the header is small, and the mounting operation within a narrow engine room can be effected easily, and the degree of freedom of layout of a circuit for the fluid (e.g. cooling medium) to be subjected to heat exchange is enhanced.

Further, the joint portion of the heat exchanger according to the invention is of the above construction, and therefore the yield of the material is enhanced. As a result, the joint portion can be provided at a low cost.

What is claimed is:

1. A joint portion fixed on a header of a heat exchanger and jointing the heat exchanger with a foreign member, comprising:

a flow hole through which a fluid passes and being communicated with a first through hole formed in a peripheral wall of the header; and a threaded hole open to an outer surface of said joint portion, a bolt is threaded into said threaded hole to fix the foreign member to said joint portion;

wherein a second through hole is formed through the peripheral wall of the header in spaced relation to the first through hole, and a part of said threaded hole is formed in an inside of the header through the second through hole.

2. The joint portion according to claim 1, further comprising a first tubular portion projecting from an inner surface of said joint portion so as to surround one end of said flow hole, said first tubular portion being snugly fitted in the first through hole.

3. The joint portion according to claim 1, wherein said threaded hole is formed so as to be parallel and spaced to said flow hole.

4. The joint portion according to claim 1, further comprising a second tubular portion projecting from an inner surface of said joint portion and having a closed distal end, wherein said part of said threaded hole is formed in an inner peripheral surface of said second tubular portion and said second tubular portion is snugly fitted in the second through hole of the header.

5. The joint portion according to claim 1, wherein said header and joint portion are made of an aluminium alloy.

6. The joint portion according to claim 1, wherein an inner surface of said joint portion is defined a concavely-curved surface substantially equal in radius of a curvature to the peripheral wall of the header.

7. The joint portion according to claim 1, wherein an outer side of said flow hole is tapered.

* * * * *